United States Patent [19]

Handschuch et al.

[11] 4,135,276

[45] Jan. 23, 1979

[54] APPARATUS FOR REMOVING IMPURITIES FROM FIBROUS MATERIAL

[75] Inventors: Karl Handschuch, Lippertshofen; Reinhard König, Kösching, both of Fed. Rep. of Germany

[73] Assignee: Schubert & Salzer, Ingolstadt, Fed. Rep. of Germany

[21] Appl. No.: 820,556

[22] Filed: Jul. 29, 1977

[30] Foreign Application Priority Data

| | | | |
|---|---|---|---|
| Aug. 3, 1976 | [DE] | Fed. Rep. of Germany | 2634769 |
| Aug. 3, 1976 | [DE] | Fed. Rep. of Germany | 2634768 |
| Mar. 23, 1977 | [DE] | Fed. Rep. of Germany | 2712650 |

[51] Int. Cl.[2] ..... D01G 9/12; D01G 9/08; D01G 9/16

[52] U.S. Cl. ..... 19/204; 19/105; 19/200

[58] Field of Search ..... 57/56, 58.95; 19/89, 19/96, 105, 107, 109, 112, 114, 204

[56] References Cited

U.S. PATENT DOCUMENTS

| | | | |
|---|---|---|---|
| 2,098,092 | 11/1937 | Hagler | 19/204 |
| 2,269,085 | 1/1942 | Morgan | 19/303 |
| 2,600,969 | 6/1952 | Clapperton | 19/105 |
| 2,788,547 | 4/1957 | Kaufman et al. | 19/98 X |
| 2,949,645 | 8/1960 | Noda | 19/105 |
| 3,144,686 | 8/1964 | Aoki | 19/105 |
| 3,205,537 | 9/1965 | Reiterer | 19/105 |
| 3,205,538 | 9/1965 | Miller et al. | 19/204 |
| 3,226,774 | 1/1966 | Reiterer | 19/105 X |
| 3,395,425 | 8/1968 | Vinogradov et al. | 19/105 |
| 3,548,461 | 12/1970 | Reiterer | 19/204 X |
| 3,766,607 | 10/1973 | Jende et al. | 19/89 X |
| 3,834,145 | 9/1974 | Ellingham | 57/56 |
| 4,004,323 | 1/1977 | Gotchel et al. | 19/89 X |

*Primary Examiner*—Donald Watkins
*Attorney, Agent, or Firm*—Bailey, Dority & Flint

[57] ABSTRACT

An apparatus for removing impurities from fibrous material such as cotton comprising a first and second clothed driven roller with said second clothed driven roller being in fiber transfer relation with said first clothed roller. A rotating cylindrical cage is provided for receiving said fibrous material from said second clothed roller by means of an air stream flowing through a passage which tapers towards said cylindrical cage. A suction is applied to the interior of the cylindrical cage for drawing air through the periphery of the cage for removing impurities from the fibrous material passing therethrough. Passages are associated with said first and second clothed rollers and have separating edges provided therein for aiding in removing impurities from said fibrous material as it passes over said rollers. In one embodiment, a plurality of calendar rollers and stripping and conveying rollers are distributed in sequence about the periphery of the cylindrical cage for increasing the cleaning action as the fibrous material is transported on the cylindrical cage.

11 Claims, 4 Drawing Figures

APPARATUS FOR REMOVING IMPURITIES FROM FIBROUS MATERIAL

BACKGROUND OF THE INVENTION

The usual mode of procedure in a spinning mill is that the fibrous material mixed with impurities is subjected to repeated cleaning in the cleaning room and the carding department before it reaches the further processing machines. The cleaning of the fibrous material in the usual opening and cleaning machines is incomplete, however. Even after passing through the carding machines, particles of dirt and, in particular, fine and very fine dust remain in the fibrous material. Satisfactory cleaning is important, however, for the following processing, particularly when using rotor spinning machines which do not include any possibility for the removal of dirt.

Proposals for an improved opening and cleaning of the fibrous material have already been made. Thus, a saw-tooth opener is known for the opening of fibrous material, particularly cotton, wherein a beater roller which is provided with pins or teeth and rotates rapidly counter to the direction of rotation of the opening roller, and a grating associated with this are disposed between the usual opening rollers and doffing rollers to remove impurities.

The fibrous material thus treated is drawn off the doffing roller by means of a stream of air and conveyed in a collecting pipe to a cage-type air separator. It is true that such a saw-tooth opener, which is disclosed in the DT-PS 1.114.127 renders possible a separation of the fibrous material into the finest fiber flocks and individual fibers. The object aimed at, however, of removing the impurities set free, is essentially only achieved with regard to the relatively coarse impurities which rub off on the edges of the grating bars. Fine and very fine impurities, on the other hand, remain in the fibrous material so that the cleaning action of this known apparatus is inadequate.

A so-called cascade cleaner has been developed for the removal of impurities including dust (U.S. Pat. No. 3,006,034). In this case, the fibrous material is compressed at the inlet side of the machine on a cylindrical cage serving as a feed device, with an associated compression roller, and is then stripped off the cage by a stripper roller which has the same direction of rotation as the cage. The impact points of the cascade cleaner are indirectly connected to the cage through conduits in order to draw off dust from the impact points through the cage. Only a weak stream of intake air can be used for this, however, because otherwise large amounts of fibrous material would be returned from the impact points to the cage with the dust. Thus, the removal of dust is unsatisfactory.

Furthermore, an apparatus for cleaning flocks of natural fiber, such as cotton flocks, of particles of dirt is known which comprises a plurality of cylindrical cages disposed in series (DT-OS 2.431.018). It is true that the removal of dust from the fibrous material for which this apparatus is intended, is improved, but the constructional expense and the necessary suction power are disproportionately high. Since the fibrous material is exposed to the streams of intake air in the individual cages in the form of more or less fine flocks, there is no assurance that dust, particularly that present in the interior of the flocks, will be completely removed, even with a high suction power.

Finally, it is also known already to provide two lickers-in with one or more compression rollers disposed in between and possibly also squeezing rollers as a feed device for a carding machine in order to improve the opening and cleaning of the fibrous material (GB-PS 1.230.331). The increased removal of dirt possible as a result mainly extends, however, to impurities of a coarser kind while fine and very fine dust in particular, and also smaller particles of dirt and fiber fragments, remain in the fibrous material.

SUMMARY OF THE INVENTION

According to the invention, this problem is solved in an apparatus having at least two clothed rollers following a feed device and a cylindrical cage to which the fibrous material is supplied by means of a stream of air. The two clothed rollers are closely surrounded by a housing which is interrupted only by separating openings with associated separating edges. The second clothed roller cooperates with the first clothed roller as a delivery and opening roller. The centrigfugal forces at the periphery of the second clothed roller are greater than at the first clothed roller.

Thus, it is now possible to free the fibrous material of all impurities in a single cleaning apparatus and with only one run through, in that first the coarse, then finer, and finally fine and very fine particles are removed from the fibrous material separated progressively into individual fibers in individual removal stages. This mode of opening renders possible a gentle separation of the fibrous material, the conditions at the individual separating points being each adapted to the nature of the separation. As a result, optimum conditions are achieved on which the satisfactory cleaning effect is based.

The second clothed roller preferably has a fiber conveying conduit tangent thereto which connects it to the cylindrical cage. An intensified impingement of the fibers on the cage, and hence, an additional cleaning effect is achieved by the fact that the fiber conveying conduit becomes narrower in a taper towards the cage. In order to increase the output of material and to obtain an even greater removal of coarser inpurities, a third clothed roller, which is closely surrounded by a housing interrupted only by separating openings, is associated with the two clothed rollers in such a manner that a carding action is exerted on the fibrous material between the first clothed roller and the third clothed roller. The second clothed roller cooperates with the first clothed roller and the third clothed roller as a delivery and opening roller. The centrifugal force appearing at the third clothed roller is less than that at the first clothed roller. The size of the separating openings is preferably adapted to the particular separating stage.

A rearrangement of the fibrous material, favorable to the cleaning, within the range of influence of the stream of intake air of the cylindrical cage is rendered possible as a result of the fact that at least one calendar roller and one stripping and conveying roller which whirls up the fibrous material are associated with the cylindrical cage between the fiber conveying conduit and a fiber takeoff point. In this manner, the fibers can be intensively cleaned of dust even with a low suction power. The direction of rotation of the stripping and conveying rollers is counter to the direction of rotation of the cylindrical cage and higher, by a multiple, than that of the cylindrical cage. A plurality of calendar rollers and stripping and conveying rollers may advantageously be distributed in sequence at the periphery of the cylindrical cage, the calendar rollers and stripping and conveying rollers being associated in pairs. As a result, the number of rearrangements is increased and the cleaning action of the cylindrical cage is further intensified. In addition, the cleaning surface of the cylindrical cage is utilized in the best possible manner and at the same time a continuous cleaning of the calender rollers by the stripping and conveying rollers is achieved. The separation and removal of the fibrous material from the cylindrical cage is reinforced by an air-blast duct which is disposed in the region of the fiber take-off point on the cylindrical cage and which extends inside the cylindrical cage over the working width thereof. As a result of the fact that the cylindrical cage is supported at one end by a bearing arrangement of the drive shaft and is mounted for free rotation on rollers at its other end, satisfactory accessibility to the interior of the cylindrical cage is provided for the introduction of the cover diaphragms and their supports. As a result of a plurality of cover diaphragms which are spaced apart and are disposed stationary in the interior of the cylindrical cage, sections of the cylindrical cage through which intake air flows and which are free of flow alternate with one another enhancing the cleaning.

Accordingly, it is an important object of the present invention to provide an apparatus which opens fibrous material in a gentle manner for removing impurities, including dust, therefrom.

Another important object of the present invention is to provide an apparatus for cleaning fibrous material, and in particular, cotton for removing coarse as well as very fine dust particles from the fibrous material.

Still another important object of the present invention is to provide an apparatus for cleaning impurities from fibrous material in an efficient and simple manner.

These and other objects and advantages of the invention will become apparent upon reference to the following specification, attendant claims, and drawing.

DESCRIPTION OF THE PREFERRED EMBODIMENT

Figure 1:
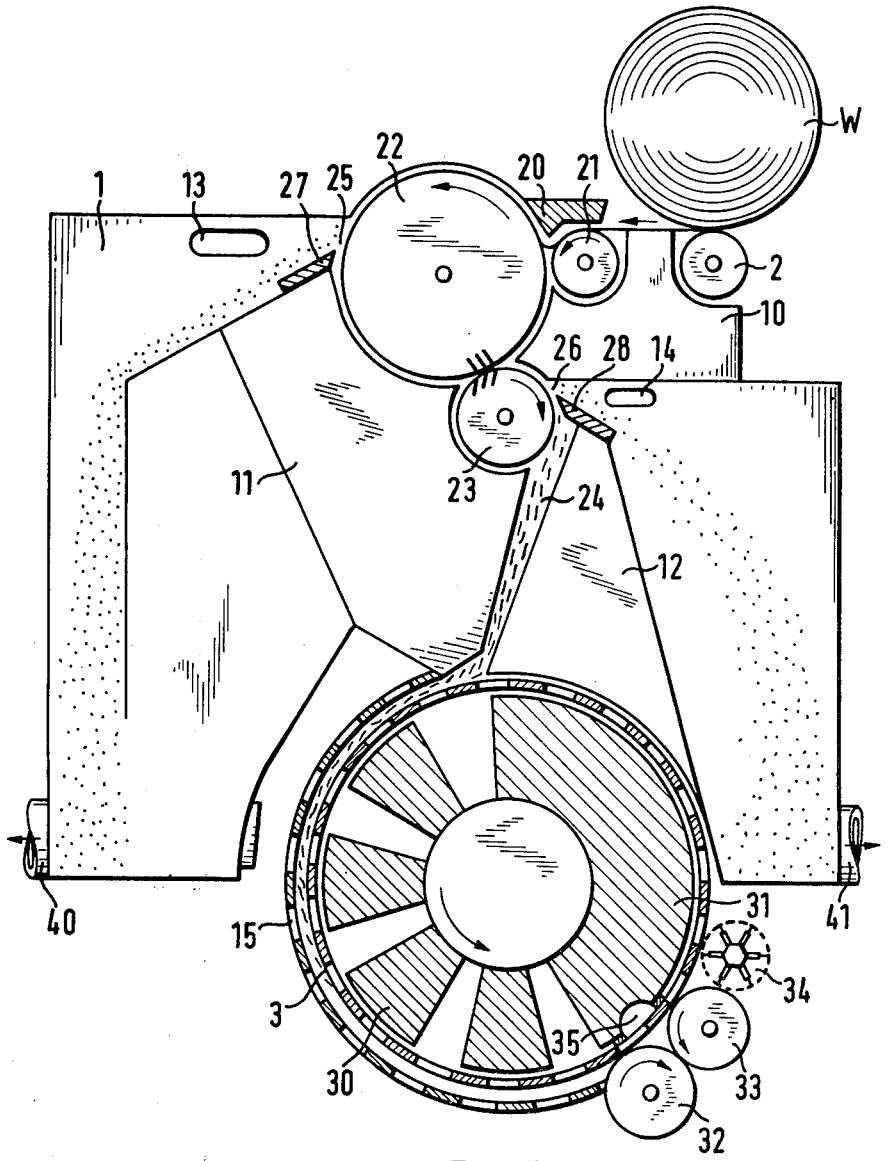
FIG. 1 is a side elevational view of a cleaning apparatus constructed in accordance with the present invention which utilizes two clothed rollers cooperating with one another with parts being in section.

The fibrous material to be cleaned, which normally is cotton, is supplied in flock form to a cleaning apparatus disposed in a closed housing 1. This is effected by providing a roll W as shown in FIG. 1 or by means of a feed hopper. The lap is supplied from the roll W resting on a roller 2 by means of a feed table 20 and a feed roller 21, while being gripped to a first clothed roller 22 which is mounted for rotation in the housing 1 and rotates in counterclockwise direction. The clothed roller 22 is followed by a second smaller clothed roller 23. The two clothed rollers 22 and 23 are covered with a saw-tooth clothing, the density of the spikes being greater in the second clothed roller 23 than in the first clothed roller 22. The clothed rollers may also be covered with fine needles or similar fiber-loosening elements.

The clothed rollers 22 and 23 are closely surrounded by the housing 1 or the housing portions 10 and 11 of which the housing portion 11, together with a further housing portion 12, forms a fiber conveying conduit 24. Thus, the clothed rollers 22 and 23 are in a closed housing which only leaves free separating openings 25 and 26 for the emergence of fiber impurities, the size of which is adapted or can be adapted to the particular removal stage. Associated with the separating opening 25 is a separating edge 27 and with the separating opening 26, a separating edge 28, which are preferably adjustably secured to the housing portions 11 and 12. The separating openings 25 and 26 are in communication with the outside air through openings 13 and 14 in the housing 1.

The clothed roller 23 which is smaller in diameter in comparison with the first clothed roller 22 rotates at a considerably higher speed than the clothed roller 22, its clothing spikes being in a removal position in relation to those of the first clothed roller 22 as indicated. From its action on the fibrous material, therefore, the clothed roller 23 may be called a delivery and opening roller. If the diameters of the clothed roller 22 and of the clothed roller 23 are in a ratio of 3:1, for example, then greater accelerations and, hence, centrifugal forces develop in the clothed roller 23 since it is rotating at a considerably higher speed than the clothed roller 22 and a higher angular velocity than in the first clothed roller 22. Thus, the centrifugal forces acting on the fibrous material increase from one clothed roller to the next. The speed of rotation of the second clothed roller 23 is preferably selected so high that the fibrous material is separated into individual fibers.

The fiber conveying conduit 24 formed by the housing portions 11 and 12 is tangent to the second clothed roller 23 and connects it to a cylindrical cage 3, extending over the whole working width of the clothed roller 23 and of the cylindrical cage. The end of the fiber conveying conduit 24 situated in the region of the clothed roller 23 is bounded by the separating edge 28. The fiber conveying conduit 24 is preferably constructed so that it becomes narrower in a taper towards the cylindrical cage 3 and extends substantially radially thereto. In FIG. 1, the longitudinal axis of the fiber conveying conduit 24 deviates somewhat from the precise radial direction. The deviation is preferably only selected so great, however, that on the one hand, a defined fiber conveying direction in the direction of rotation of the cylindrical cage 3 is obtained while on the other hand, an impingement effect of the fibers on the cylindrical cage 3 is achieved which is recognized here as being important and is aimed at.

Figure 2:
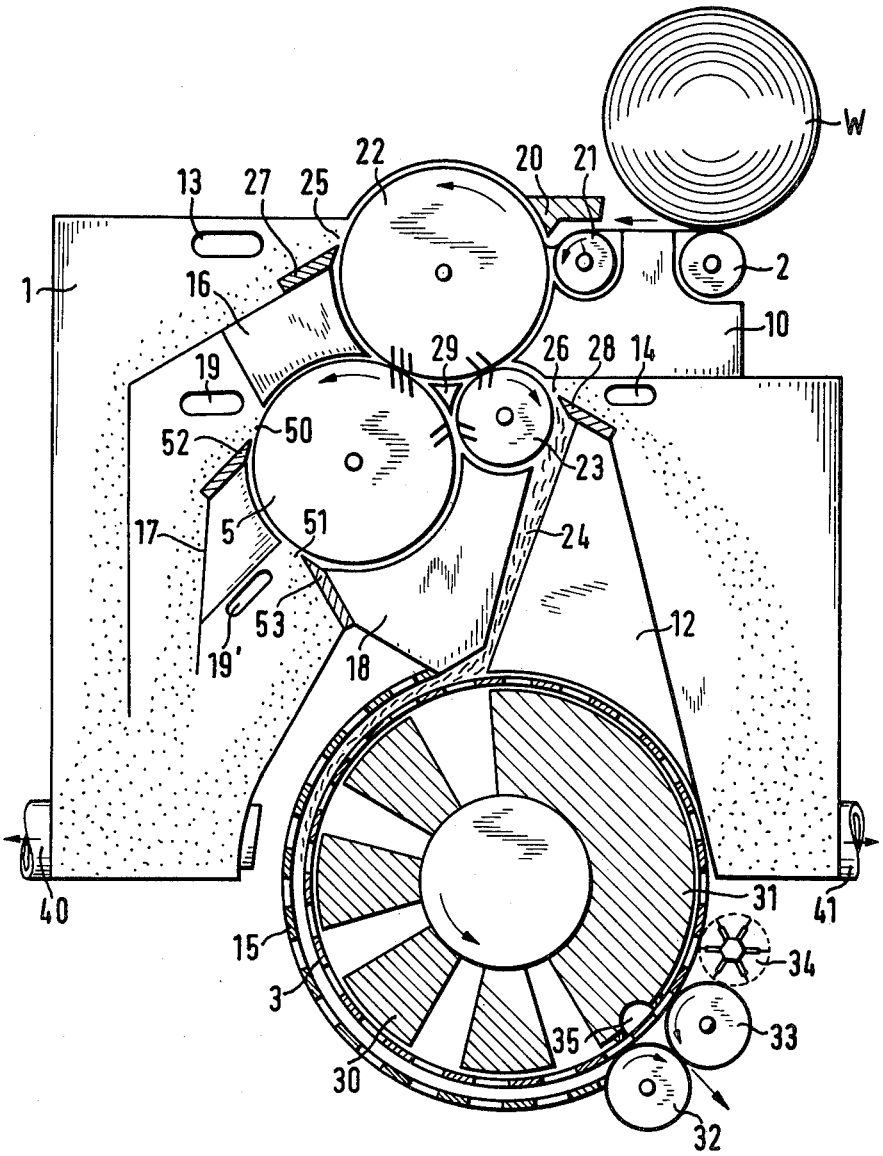
FIG. 2 is a side elevational view of parts in section illustrating a modified form of the invention.
Figure 3:
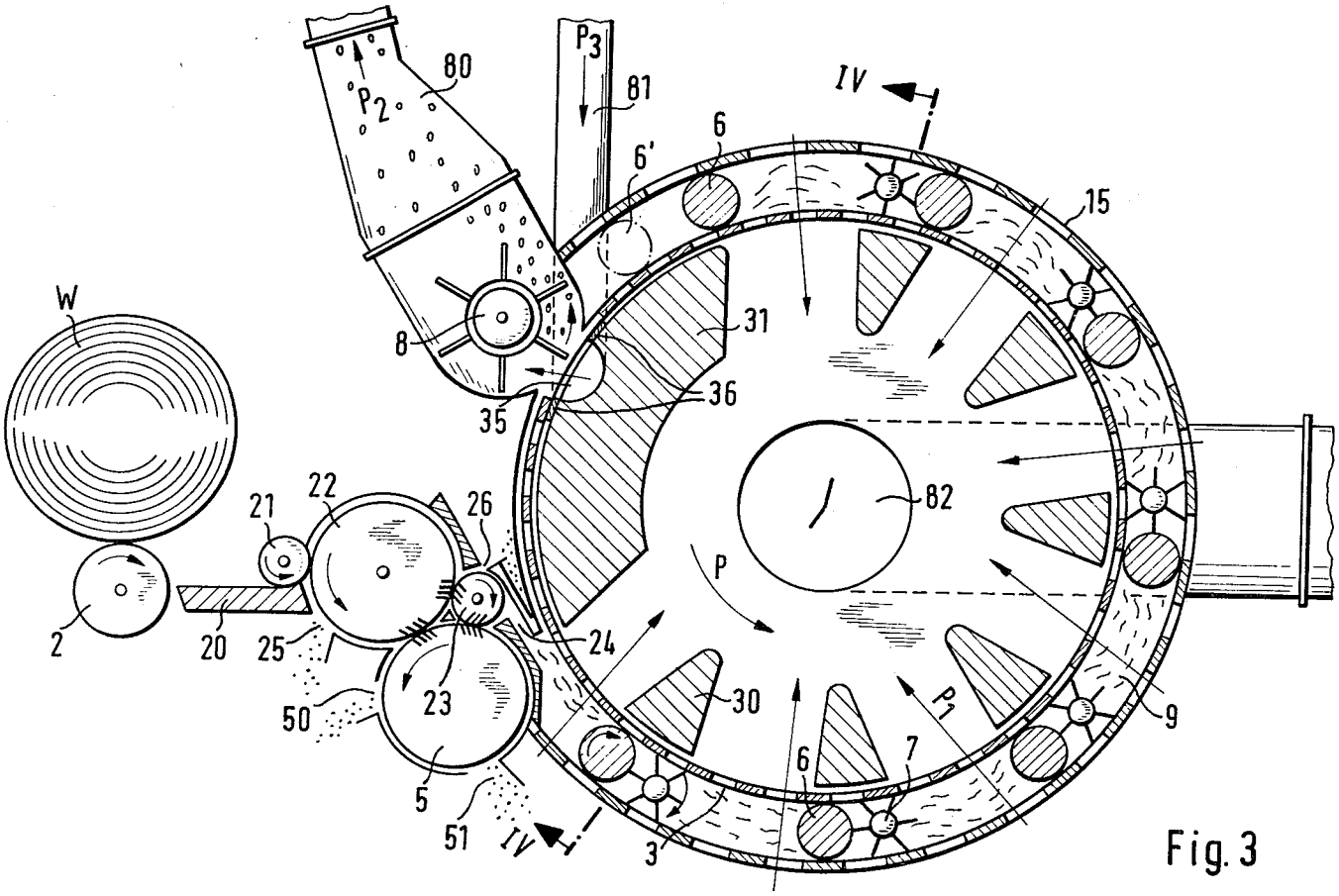
FIG. 3 is a side elevational view partially in section illustrating a third embodiment of an apparatus constructed in accordance with the present invention.
Figure 4:
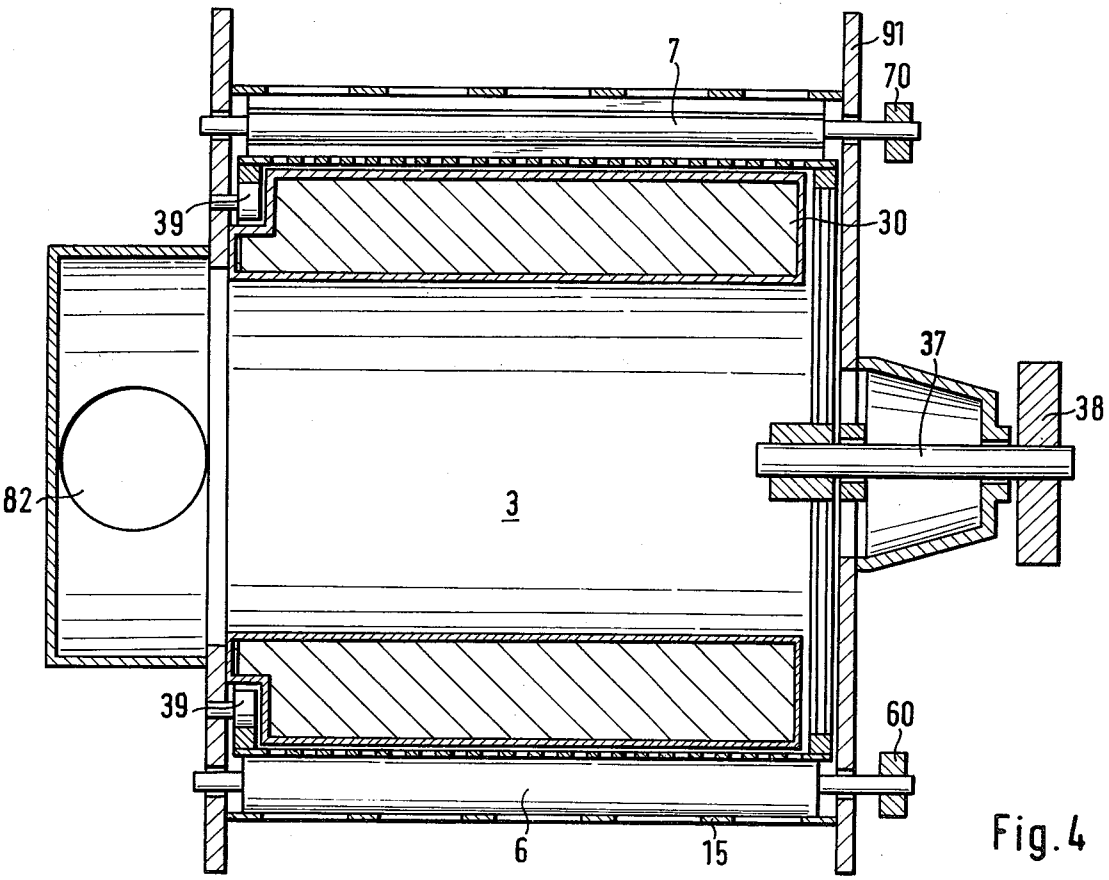
FIG. 4 is a sectional view taken along line 4—4 of FIG. 3.

The cylindrical cage 3, which is surrounded by a perforated housing portion 15, is driven in the direction of the arrow and in order to produce a reduced pressure in its interior, it is connected to a suction device not shown in FIG. 1 but is shown in the example of an embodiment according to FIGS. 3 and 4 and will be described in more detail there. The reduced pressure continues via the fiber conveying conduit 24 as far as the clothed roller 23. Spaced apart cover diaphragms 30 and a cover diaphragm 31 are disposed stationary in the interior of the cylindrical cage 3 and keep partial regions of the cylindrical cage 3 free of flow. Associated with the cylindrical cage 3 in the region of the cover diaphragm 31, is a take-off device which, in the example, consists of a pair of delivery rollers 32, 33. A circular brush 34 which follows the delivery roller 33 strips off any fibers which may still be clinging to the cylindrical cage and at the same time cleans the delivery roller 33. In order to reinforce the removal of the fiber fleece from the cylindrical cage 3 by the delivery rollers 32 and 33, an air-blast duct 35 may appropriately be associated with the latter and, as in the example of an embodiment as shown in the FIGS. 1 to 3, is formed by a semicircular recess in the cover diaphragm 31 at its side adjacent to the wall of the cylindrical cage.

The mode operation is as follows: The lap running off the roll W and consisting of fiber flocks is supplied by the feed roller 21 to the first clothed roller 22 while being gripped, and the first clothed roller combs through the fibrous material and entrains tufts of fiber on its clothing. When the clothed roller 22 travels past the separating opening 25 with the separating edge 27, short fibers and coarse impurities are slung out of the fibrous material by the centrifugal force, according to the peripheral speed and curvature of this roller and the size of the separating opening adapted to this first removal stage. After passing through the separating opening 25, these short fibers and coarse impurities enter a dirt chamber in the housing 1. The fibrous material, which has thus been preliminarily cleaned, is removed from the first clothed roller 22 by the clothing spikes of the second clothed roller 23, being further loosened, and is conveyed past the separating opening 26 with the separating edge 28. Since, as stated above, the centrifugal force produced in the second clothed roller 23 is greater than in the first clothed roller 22, the finer particles of dirt and dust contained in the fibrous material are separated out of this at the separating opening 26. As a result of the separation of the fibrous material into individual fibers or at least very fine fiber flocks by means of the clothed roller 23, the separation of these finer impurities from the fibrous material is enhanced. The impurities and bits of fiber separated out at the separating openings 25 and 26 may appropriately be drawn off through pipelines 40 and 41. This may be effected continuously or also discontinuously in order to avoid disturbances to the circulation of the air at the separating openings.

After passing the separating opening 26, the fibrous material becomes detached from the second clothed roller 23 as a result of the air entering the housing 1 and the separating opening 26 through the opening 14, and of the centrifugal force, and passes through the fiber conveying conduit 24 to the cylindrical cage 3 on which it impinges at an acute angle in the example of an embodiment shown. As a result of the tapered construction of the fiber conveying conduit 24, which becomes narrower towards the cylindrical cage 3, the fibers in the fiber conveying conduits 24 are subjected to an additional acceleration which causes a further separation of the fibers and an increase in the impingement energy on the cylindrical cage 3. Fine and very fine impurities still present in the fibrous material, such as fragments of dust and fiber, are removed by the impingement of the fibers on the cylindrical drum 3. They pass through the perforated wall of the cylindrical cage 3 and are supplied by the stream of intake air to a dust filter (not shown), while the fibers are deposited on the cylindrical cage 3 and form a fiber fleece there. After passing through the dust filter, the intake air is again supplied to the apparatus so that there is a closed, controlled air system. The speed of rotation of the cylindrical cage 3 is preferably selected so high that the fiber fleece forming on the wall of the cylindrical cage 3 is only so thick that it does not itself act as a dust filter during the separation of the remaining dust and fly taking place during the conveying on the cylindrical cage 3. In accordance with the division of the region of the cylindrical cage into sections which are kept free of flow by the provision of the cover diaphragms 30 and sections situated therebetween through which intake air flows, the fiber fleece, while being conveyed on the cylindrical cage 3, is alternately sucked against the wall of the cylindrical cage 3 and then left loose again. In this manner, a kind of beating or wobble effect is produced which effectively influences the dust separation.

The fiber fleece which has thus been well cleaned is finally removed from the cylindrical cage 3 by the delivery rollers 32 and 33, the air-blast stream supplied through the air-blast duct 35 reinforcing the removal of the fleece. In order to achieve a certain doubling of the fiber fleece during the removal, the peripheral speed of the delivery rollers 32 and 33 is preferably kept somewhat lower than that of the cylindrical cage 3. The fiber fleece taken off is rolled into a roll or supplied directly, possibly with the interposition of a storage chamber, to a following machine, particularly a card.

In the example of an embodiment as shown in FIG. 2, a third clothed roller 5 is associated with the two clothed rollers 22 and 23 of FIG. 1 as a result of which the output of material is increased and a more intensive preliminary removal of coarser foreign bodies such as bits of husk and the like is achieved. The third clothed roller 5 has the same diameter as the first clothed roller 22 and, like this, rotates in counterclockwise direction, but at a lower speed, for example, at half the speed of rotation of the clothed roller 22. The clothing spikes of the clothed rollers 22 and 5 are in the carding position in relation to one another, as indicated, while the clothing spikes of the second clothed roller 23, which is disposed in the angle formed by the clothed rollers 22 and 5, is in the takeoff position in relation to the clothing spikes of the clothed rollers 22 and 5. It can be seen that with this embodiment also, the centrifugal forces which arise increase from the first clothed roller 22 to the second clothed roller 23 and from the third clothed roller 5 to the second clothed roller 23.

The clothed roller 5 is closely surrounded by housing portions 16, 17 and 18 which also partially surround the clothed rollers 22 and 23, so that the clothed roller 5, like the clothed rollers 22 and 23 cooperating therewith, rotates in a closed housing interrupted only by two separating openings 50 and 51. A profile member 29 is disposed stationarily between the three clothed rollers 22, 23 and 5 and prevents eddy currents. Associated with the separating opening 50 is a separating edge 52 and with the separating opening 51 a separating edge 53, which are adjustably secured to the housing portions 17 and 18. The separating openings 50 and 51 are in communication with the free atmosphere through openings 19 and 19' in the housing 1. The fiber conveying conduit 24, which connects the second clothed roller 23 to the cylindrical cage 3 and becomes narrower in a taper towards the latter, is here formed by the housing portions 18 and 12.

Apart from this, this embodiment of the cleaning apparatus corresponds to that shown in FIG. 1 so that the description of operation can be restricted to the effect of the third clothed roller 5. This consists in that a carding of the fibrous material is effected by the cooperation of the first clothed roller 22 and the third clothed roller 5, through which tufts of fiber are opened out and the fibers are stretched and laid parallel. In the course of this, some of the fibrous material remains on the first clothed roller and is removed from this by the second clothed roller 23 with further loosening at the same time. The rest of the fibrous material travels from the clothing of the first clothed roller 22 to that of the third clothed roller 5 and is conveyed past the separating openings 50 and 51 with the separating edges 52 and 53. In the course of this, comparatively coarse impurities, which enter the dirt chamber in the housing 1, are separated out of the fibrous material depending on the peripheral speed and the curvature of the clothed roller 5 and the setting of the separating openings 50 and 51 or separating edges 52 and 53. The clothed roller 5, with the same diameter as the clothed roller 22, rotates at a slower speed than the clothed roller 22 so that the accelerations and centrifugal forces arising in the clothed roller 5 are correspondingly less. These are sufficient, however, for the separating out of the coarser impurities because the impurities have been exposed by the preceding carding of the fibrous material and can, therefore, be easily slung out of the fibrous material. Then the second clothed roller 23 removes the fibrous material from the clothing of the third clothed roller 5 and conveys it past the separating opening 26 with the separating edge 28, like the material removed from the first clothed roller 22. Finer impurities are separated out there, as already explained with reference to FIG. 1, and finally, the finest impurities are separated out on the cylindrical cage 3.

In the example of an embodiment as shown in FIG. 3, in which the parts already shown and described with reference to FIGS. 1 and 2 are designated accordingly, a plurality of calendar rollers 6 for pressing the fibrous material against the cylindrical cage 3 and stripping and conveying rollers 7 are distributed over the periphery of the cylindrical cage 3. The stripping and conveying rollers 7 detach the fibrous material from the cylindrical cage 3 and convey it in the direction of rotation of the cylindrical cage, while they exert a whirling effect on the fibers, as will be explained later. As a result of this whirling up, the fibrous material is turned or rearranged. Each calendaring roller 6 is preferably followed by a stripping and conveying roller 7, seen in the direction of rotation P of the cylindrical cage 3. Each calender roller 6 and the following stripping and conveying roller 7 may advantageously be disposed in pairs, each pair being spaced apart from the following one. As a result, on the one hand the effective cleaning surface of the cylindrical cage 3 is utilized in the best possible manner and on the other hand the blades of the stripping and conveying rollers 7, which consist of plastic material, leather or the like, come into contact with the calendar rollers 6 and so exert a continuous cleaning action on the latter. There is, however, likewise the possibility of mounting the stripping and conveying rollers 7 with spacing from the calendar rollers 6. In the example, six pairs of calendar rollers 6 and stripping and conveying rollers 7 are distributed in sequence over the periphery of the cylindrical cage, but their number may also be increased, depending on the degree of soiling and the diameter of the cylindrical cage 3 or be reduced to one calender roller 6 and one stripping and conveying roller 7. The calendar rollers 6 and stripping and conveying rollers 7 have the same direction of rotation, opposite to the direction of rotation P of the cylindrical cage 3, with a different peripheral speed. Whereas the peripheral speed of the calendar rollers corresponds substantially to the peripheral speed of the cylindrical cage 3, the peripheral speed of the stripping and conveying rollers is higher by a multiple. The cover diaphragms 30 mounted stationarily in the interior of the cylindrical cage 3 keep at least the working range of the stripping and conveying rollers 7 at the cylindrical cage 3 free of air flow, but preferably also the working range of the calendar rollers 6.

Following but spaced from the last pair of rollers consisting of a calendar roller 6 and stripping and conveying roller 7, seen in the direction of rotation P of the cylindrical cage 3, is yet another calendar roller 6, selectively also a second calendar roller 6', so that the fibrous material arrives in fleece form at a stripper roller 8 disposed in the fiber removal region. The stripper roller 8 effects the final separation of the fibrous material from the cylindrical cage 3, which material is conveyed away, by means of a stream of air $P_2$ through a conveying conduit 80 to a following machine, for example, a card, or is removed from the cylindrical cage 3 by means of the delivery rollers shown in FIGS. 1 and 2. In the course of this, the cover diaphragm 31 in the interior of the cylindrical cage 3, which extends from the calendar roller 6 following on the last pair of rollers to the fiber conveying conduit 24 connecting the second clothed roller 23 to the cylindrical cage 3, keeps the reduced pressure in the cylindrical cage away from the fiber removal region. In order to reinforce the removal of fleece from the cylindrical cage 3 by the stripper roller 8, associated with this stripper roller is the air-blast duct 35 which has already been referred to in the description of FIG. 1 and which is formed by the semicircular recess in the cover diaphragm 31 at its face adjacent to the wall of the cylindrical cage 3. The air-blast duct 35 extends over the working width of the cylindrical cage 3 and is connected by a pipeline 81, to a blower (not shown) producing an air-blast stream $P_3$. Seals 36 fitted to the cover diaphragm 31 separate the streams of air $P_2$ and $P_3$ from the stream of intake air $P_1$ flowing into the interior of the cylindrical cage 3. Such seals may also be provided on the cover diaphragms 30.

The cylindrical cage and the calendar rollers 6 and stripping and conveying rollers 7 distributed in succession at its periphery, are surrounded by the housing portion 15 provided with air slots, in such a manner that an annular passage 9, which extends from the fiber conveying conduit 24 to the fiber removal point defined by the stripper roller 8, is formed between this housing portion and the cylindrical cage 3, in which passage the calendar rollers 6 and stripping and conveying rollers 7 lie. The calendar rollers 6 assume the function of sealing elements in the passage 9 insofar as they divide the stream of intake air $P_1$ into the individual cleaning regions between the pairs of rollers.

In order to produce a reduced pressure in its interior, the cylindrical cage 3 is connected by a suction passage 82 to a suction device (not shown) and is driven in the direction of the arrow P (FIG. 3) via a drive shaft 37 with a drive pulley (38) (FIG. 4) which is mounted in a frame 91. Thus, the cylindrical cage 3 is simultaneously supported at the drive side by the bearing arrangement of the drive shaft 37. At the other end, the cylindrical cage 3 is mounted for free rotation on rollers 39. The frame 91 has an opening at this side. Thus, the interior of the cylindrical cage 3 is accessible, at the side opposite the drive side, for the introduction of the cover diaphragms 30 and 31 which are fixed in position in a suitable manner by supports (not shown). The drive of the calendar rollers 6 and stripping and conveying rollers 7, likewise mounted in the frame 91, is effected through drive pulleys 60 and 70, respectively.

With this form of embodiment of the cleaning apparatus, as a result of the centrifugal forces increasing from the first clothed roller 22 and third clothed roller 5 to the second clothed roller 23, the comparatively coarse impurities are separated out of the fibrous material fed from the roll W or a feed hopper, at the separating apertures 25, 50 and 51, then finer impurities are removed at the separating opening 26 and finally, after the fibrous material has been supplied through the fiber conveying conduit 24 to the cylindrical cage 3, the remaining fine and very fine impurities still contained in the fibrous material are removed.

It should be noted here that in contrast to FIGS. 1 and 2, the fiber conveying conduit 24 shown in FIG. 3 is not tapered and, in addition, is arranged so that it is tangent to the cylindrical cage 3. This is possible in view of the intensified cleaning effect which is described below and which occurs with this form of embodiment of the cylindrical cage 3. Naturally, however, the fiber conveying conduit may here also have the construction and position shown in FIGS. 1 and 2, with the advantages described there.

After passing through the fiber conveying conduit 24, the fibrous material which is preferably separated into individual fibers, enters the stream of intake air which is indicated by arrows $P_1$ and which flows through the air slots in the housing 15 and the perforated wall of the cylindrical cage 3, into the interior thereof and exerts a cleaning effect on the fibers. While dust and fragments of fibers pass through the screen of the cylindrical cage 3 and are supplied via the passage 82 to a dust filter (not shown), the fibers are deposited on the cylindrical cage 3. They are pressed against the cylindrical cage 3 and smoothed by the first calendar roller 6 and then stripped off the cylindrical cage 3 by the following stripping and conveying roller 7. Since the peripheral speed of the stripping and conveying rollers 7 is higher, by a multiple, than that of the cylindrical cage 3, this stripping off takes place with great acceleration of the fibers so that they are whirled up counter to the stream of intake air $P_1$ and at the same time, are conveyed in the direction of rotation P of the cylindrical cage 3. It is, therefore, important to regulate the stream of intake air so that on the one hand, adequate suction of the dust is effected, but on the other hand, an adequate whirling up and, hence, rearrangement of the fibrous material is rendered possible. For this purpose, a regulating device may appropriately be provided for the stream of intake air, so as to render possible an adjustment to different fiber materials.

After the first whirling up, the fibers again form a fleece on the surface of the cylindrical cage 3, under the influence of the stream of intake air $P_1$. This fleece is now pressed against the cylindrical cage 3 and smoothed by the following calendar roller 6 and stripped off, with whirling up, by the associated stripping and conveying roller 7. The stripping and conveying rollers always exert a beating action on the cylindrical cage 3 and so prevent blockage of the perforation of the cylindrical cage. This process is repeated continuously, in the manner described, over the periphery of the cylindrical cage 3, until the fleece compressed by the last calendar roller 6 or 6' is stripped off the cylindrical cage 3 by the stripper roller 8 and the fibers are removed. It can be seen that, as a result of the whirling effect of the stripping and conveying rollers 7, a rearrangement of the fibers in the following fleece is effected between each pair of rollers. As a result, in the course of the cleaning process, even the fibers which were originally further away from the screen wall come into direct contact with the screen wall of the cylindrical cage 3. This leads to a particularly intensive cleaning of the fibrous material from dust and dust-like impurities by the concentration of the stream of intake air $P_1$ on the cleaning points between the cover diaphragms 30 and 31 and its action on the fibers in the whirled up state before the particular fleece formation. This intensive cleaning is still assured when a relatively thick fiber fleece passes the cylindrical cage 3, which is aimed at in order to achieve a high production output of the apparatus.

While a preferred embodiment of the invention has been described using specific terms, such description is for illustrative purposes only, and it is to be understood that changes and variations may be made without departing from the spirit or scope of the following claims.

What is claimed is:

1. An apparatus for removing impurities from fibrous material such as cotton, comprising:

a first clothed driven roller;

means for feeding said fibrous material to be cleaned to said first clothed roller;

a second clothed driven roller following said first clothed roller in fiber transfer relation with said first clothed roller;

a rotating cylindrical cage;

air stream means for supplying said fiber material from said second clothed roller to said rotating cylindrical cage;

a housing closely surrounding said first and second clothed rollers;

an opening provided in said housing adjacent said first clothed roller through which impurities are expelled from said fibrous material as said fibrous material is transported by said first clothed roller;

an opening provided in said housing adjacent said second clothed roller through which impurities are expelled from said fibrous material as said fibrous material is transported by said second clothed roller;

said second clothed roller cooperating with said first clothed roller for completely transferring said fibrous material from said first clothed roller and opening said fibrous material, said first and second clothed rollers being driven so that the centrifugal forces at the periphery of said second clothed roller are greater than at said first clothed roller, and said rotating cylindrical cage being spaced from said first clothed roller so that the fibrous material passing through said apparatus first engages said first clothed roller, then is transferred to said second clothed roller where said air stream means removes said fibrous material and feeds said fibrous material to said cylindrical cage.

2. The apparatus as set forth in claim 1 further comprising:

a fiber conveying conduit through which said air stream flows extending between said second clothed roller and said cylindrical cage and having a portion tangent to said second clothed roller for conveying the fibrous material from said second clothed roller to said cylindrical cage.

3. The apparatus as set forth in claim 2 further comprising:

said fiber conveying conduit becomes narrow in a taper towards said cylindrical cage.

4. The apparatus as set forth in claim 1 further comprising:

a plurality of calendar rollers and stripping and conveying rollers distributed in sequence about the periphery of said cylindrical cage, said calendar rollers and said stripping rollers being disposed about said periphery of said cylindrical cage in pairs.

5. The apparatus as set forth in claim 1 further comprising:

a drive shaft operably connected to one end of said rotating cylindrical cage, a bearing means for supporting said drive shaft and said one end of said cage, and means for mounting the other end of said cage for free rotation.

6. The apparatus as set forth in claim 1 further comprising:

a plurality of cover diaphragms stationarily disposed in the interior of said cylindrical cage, and said cover diaphragms being spaced apart from one another.

7. The apparatus as set forth in claim 1 further comprising:

spiked clothing carried on said first and second clothed rollers with the density of spikes of second clothed roller being greater in comparison than the density of said first clothed roller.

8. An apparatus for removing impurities from fibrous material such as cotten, comprising:

a first clothed driven roller;

means for feeding said fibrous material to be cleaned to said first clothed roller;

a second clothed driven roller following said first clothed roller in fiber transfer relation with said first clothed roller;

a rotating cylindrical cage;

air stream means for supplying said fiber material from said second clothed roller to said rotating cylindrical cage;

a housing closely surrounding said first and second clothed rollers;

an opening provided in said housing adjacent said first clothed roller through which impurities are expelled from said fibrous material as said fibrous material is transported by said first clothed roller;

an opening provided in said housing adjacent said second clothed roller through which impurities are expelled from said fibrous material as said fibrous material is transported by said second clothed roller;

said second clothed roller cooperating with said first clothed roller as a delivery and opening roller for said fibrous material;

said first and second clothed rollers being driven so that the centrifugal forces at the periphery of said second clothed roller are greater than at first clothed roller, a third driven clothed roller;

a housing surrounding said third clothed roller;

openings provided in said housing adjacent said third clothed roller through which impurities are expelled from said fibrous material as said fibrous material is transported by said third clothed roller;

means for positioning said third clothed roller relative to said first and second clothed rollers so that a carding effect is exerted on said fibrous material between said first clothed roller and said third clothed roller and said second clothed roller cooperates as a delivery and opening roller with said first clothed roller and said second clothed roller; and said third clothed roller being driven so that the centrifugal force appearing at said third clothed roller is less than that at said first clothed roller.

9. An apparatus for removing impurities from fibrous material such as cotton, comprising:

a first clothed driven roller;

means for feeding said fibrous material to be cleaned to said first clothed roller;

a second clothed driven roller following said first clothed roller in fiber transfer relation with said first clothed roller;

a rotating cylindrical cage;

air stream means for supplying said fiber material from said second clothed roller to said rotating cylindrical cage;

a housing closely surrounding said first and second clothed rollers;

an opening provided in said housing adjacent said first clothed roller through which impurities are expelled from said fibrous material as said fibrous material is transported by said first clothed roller;

an opening provided in said housing adjacent said second clothed roller through which impurities are expelled from said fibrous material as said fibrous material is transported by said second clothed roller;

said second clothed roller cooperating with said first clothed roller as a delivery and opening roller for said fibrous material, said first and second clothed rollers being driven so that the centrifugal forces at the periphery of said second clothed roller are greater than at said first clothed roller, a calendar roller carried on said cylindrical cage for pressing said fibrous material against said cylindrical cage;

a fiber stripping and conveying roller carried on said cylindrical cage for whirling up the fibrous material as it is transported to a fiber takeoff point associated with said rotating cylindrical cage, and means for applying a negative pressure to the interior of said cylindrical cage for withdrawing additional trash from said whirling up fibrous material as said fibrous material is transported on said cylindrical cage.

10. The apparatus as set forth in claim 9 further comprising:

means for rotating said stripping and conveying rollers in a direction counter to the direction of rotation of said cylindrical cage and at a higher peripheral speed of rotation than that of the cylindrical cage.

11. An apparatus for removing impurities from fibrous material such as cotton, comprising:

a first clothed driven roller;

means for feeding said fibrous material to be cleaned to said first clothed roller;

a second clothed driven roller following said first clothed roller in fiber transfer relation with said first clothed roller;

a rotating cylindrical cage;

air stream means for supplying said fiber material from said second clothed roller to said rotating cylindrical cage;

a housing closely surrounding said first and second clothed rollers;

an opening provided in said housing adjacent said first clothed roller through which impurities are expelled from said fibrous material as said fibrous material is transported by said first clothed roller;

an opening provided in said housing adjacent said second clothed roller through which impurities are expelled from said fibrous material as said fibrous material is transported by said second clothed roller;

said second clothed roller cooperating with said first clothed roller as a delivery and opening roller for said fibrous material;

said first and second clothed rollers being driven so that the centrifugal forces at the periphery of said second clothed roller are greater than at said first clothed roller,;

a fiber takeoff means associated with said rotating cylindrical cage, and an air blast duct disposed in the region of said fiber takeoff means for directing a flow of air outwardly through said cylindrical cage for aiding in removing the fibrous material therefrom.

* * * * *